US006944957B2

(12) United States Patent
Donnerdal et al.

(10) Patent No.: US 6,944,957 B2
(45) Date of Patent: Sep. 20, 2005

(54) CHAIN SAW WITH A TENSIONING ARRANGEMENT

(75) Inventors: Ove Donnerdal, Sävedalen (SE); Tore Claesson, Örby (SE)

(73) Assignee: Aktiebolaget Electrolux (Publ), Stockholm (SE)

( * ) Notice: Subject to any disclaimer, the term of this patent is extended or adjusted under 35 U.S.C. 154(b) by 0 days.

(21) Appl. No.: 10/502,756

(22) PCT Filed: Jan. 16, 2003

(86) PCT No.: PCT/SE03/00056

§ 371 (c)(1),
(2), (4) Date: Aug. 9, 2004

(87) PCT Pub. No.: WO03/064125

PCT Pub. Date: Aug. 7, 2003

(65) Prior Publication Data

US 2005/0044727 A1 Mar. 3, 2005

(30) Foreign Application Priority Data

Jan. 28, 2002 (SE) ..... 0200219

(51) Int. Cl.[7] ..... B27B 17/14
(52) U.S. Cl. ..... 30/386; 30/383
(58) Field of Search ..... 30/386, 383, 385; 83/814; 474/111

(56) References Cited

U.S. PATENT DOCUMENTS 5,491,899 A * 2/1996 Schliemann et al. ..... 30/386
6,493,949 B2 12/2002 Kondo et al.
6,532,671 B1 * 3/2003 Jong ..... 30/386
6,564,459 B1 * 5/2003 Steinbrueck et al. ..... 30/383
2001/0042311 A1 11/2001 Kondo et al.
2002/0124421 A1 * 9/2002 Hermes et al. ..... 30/386
2003/0024129 A1 * 2/2003 Franke et al. ..... 30/386

FOREIGN PATENT DOCUMENTS

| | | | |
|---|---|---|---|
| DE | 42 20 845 | A1 | 1/1994 |
| DE | 199 31 250 | A1 | 11/2001 |
| DE | 199 63 650 | A1 | 12/2001 |
| GB | 2 354 481 | A | 3/2001 |
| SU | 802015 | | 8/1987 |
| SU | 1329966 | A1 | 8/1987 |

* cited by examiner

*Primary Examiner*—Douglas D Watts
(74) *Attorney, Agent, or Firm*—Nixon & Vanderhye

(57) ABSTRACT

The invention concerns a motor powered saw with a saw chain (2) and a guide bar (1), the rear portion of which is covered by a side cover (3) and during operation clamped with a certain clamping force between the side cover and a counter support on that side of the guide bar which is turned towards the motor, tensioning elements being provided for tensioning the saw chain by displacing the guide bar forwards, when the guide bar has been loosened by easing the clamping force, and elements for securing the guide bar in a new position. The characteristic features of the invention are that a rotation element (4) is mounted or mountable on the exterior of the side cover for easing said clamping force by rotating the rotating element a first angle of rotation; for activating said tensioning elements by continued rotation of the rotation element a further, second angle of rotation, said tensioning elements comprising a guide bar displacer (50, 50') for displacing the guide bar forwards to anew position for tensioning the chain; and for reclamping the guide bar, but now in the new position, by returning the rotation element to its starting position.

16 Claims, 14 Drawing Sheets

CHAIN SAW WITH A TENSIONING ARRANGEMENT

This application is the U.S. National Phase of International Application PCT/SE03/00056, filed 16 Jan. 2003, which designated the U.S.

TECHNICAL FIELD

The invention relates to a motor powered saw including a saw chain and a guide bar, the rear portion of which is covered by a side cover and during operation clamped with a certain clamping force between the side cover and a counter support on that side of the guide bar which is turned towards the motor, tensioning elements for tensioning the saw chain by displacing the guide bar forwards, when the guide bar has been loosened by easing the clamping force, and elements for securing the guide bar in a new position.

BACKGROUND OF THE INVENTION

When the saw chain of motor powered saws shall be tensioned, various tools conventionally need to be used for easing the clamping force which the side cover, which normally consists of the so called clutch cover, exerts on the rear portion of the guide bar, in order thereafter to be able to tension the chain and secure it in a new position. Moreover, the chain tensioner usually is difficult to access and/or is very dirty. All this makes the chain tension cumbersome. This is an important disadvantage of existing motor chain saws and this is particularly true for motor chain saws intended for sawing in rock and concrete, because the saw chains used for such motor saws often need to be tensioned, as cuttings get in between links of the chain and cause wear of the rivets.

BRIEF DESCRIPTION OF THE INVENTION

It is the purpose of the invention to provide a motor powered saw of the above mentioned kind allowing the saw chain to be tensioned by a few simple manual operations. This can be achieved therein that a rotation element is mounted or mountable on the exterior of the side cover for easing said clamping force by rotating the rotation element a first angle of rotation; for activating said tensioning elements by continued rotation of the rotation element a further, second angle of rotation, said tensioning elements comprising a guide bar displacer for displacing the guide bar forwards to a new position for tensioning the chain; and for reclamping the guide bar, but now in the new position, by returning the rotation element to its starting position.

Further features and aspects of the invention will be apparent from the independent patent claims and from the following, detailed description of two preferred embodiments.

BRIEF DESCRIPTION OF DRAWINGS

In the following description of two preferred embodiments, reference will be made to the accompanying drawings, in which FIG. 1 is a side view of a motor powered saw, where the invention is implemented according to the first embodiment, FIG. 2 is a perspective view of a side cover, FIG. 3 shows the interior of the side cover, FIG. 4 shows a cross-sectional view of the side cover along a line IV—IV in FIG. 3, FIG. 5 is a side view of a rotation sleeve, and FIG. 6 shows the rotation sleeve from an inner end in a view VI—VI in FIG. 5, FIG. 7 is a side elevation of a tensioning lever and FIG. 8 shows the tensioning lever in a view along the line VIII—VIII in FIG. 7, FIG. 9 is a side elevation of a guide bar displacer and FIG. 10 shows an end view of the guide bar displacer along the line X—X in FIG. 9, FIG. 11 is a side elevation of a pawl and FIG. 12 shows the pawl in a view along the line XII—XII in FIG. 11, FIG. 13 shows an assembly consisting of the side cover and a guide bar support, which is mounted on a crankcase of the motor powered saw, including the elements which are shown in FIG. 1–FIG. 12 mounted in the side cover, the guide bar being secured between the side cover and a guide bar support along a line corresponding to the line IV—IV in FIG. 3, and FIGS. 14A, 14B, and 14C illustrate three different phases of the chain tensioning operation.

FIG. 15 is a perspective side elevation of a side cover according to this embodiment, FIG. 16 is a perspective view of a lid for an opening in the side cover, FIG. 17 shows the lid in a view along the line XVII—XVII in FIG. 16, FIG. 18 shows a clamping plate with a tensioning and locking assembly on the interior of the side cover.

DESCRIPTION OF PREFERRED EMBODIMENTS

Figure 1:
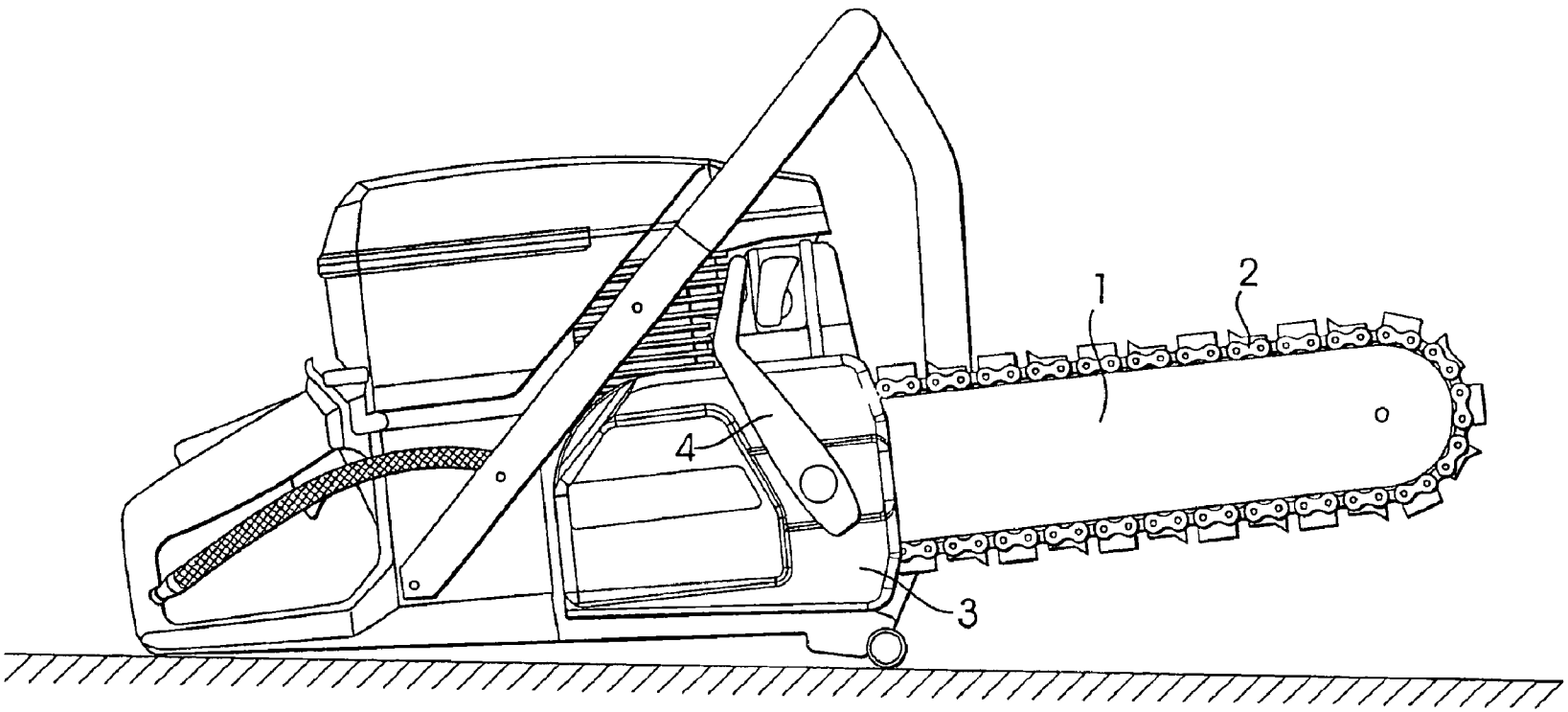
FIGS. 1–14C illustrate a first embodiment of the invention, where
Figure 2:
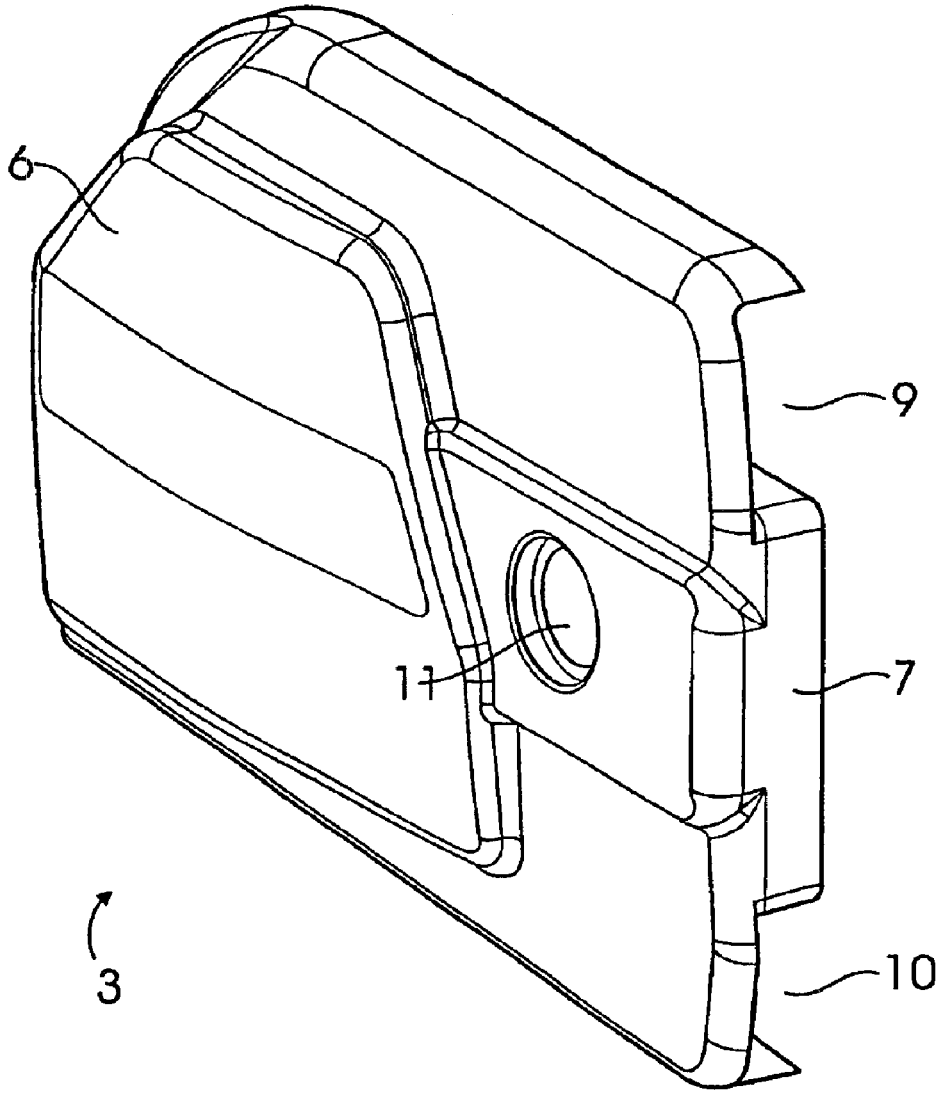
Figure 3:
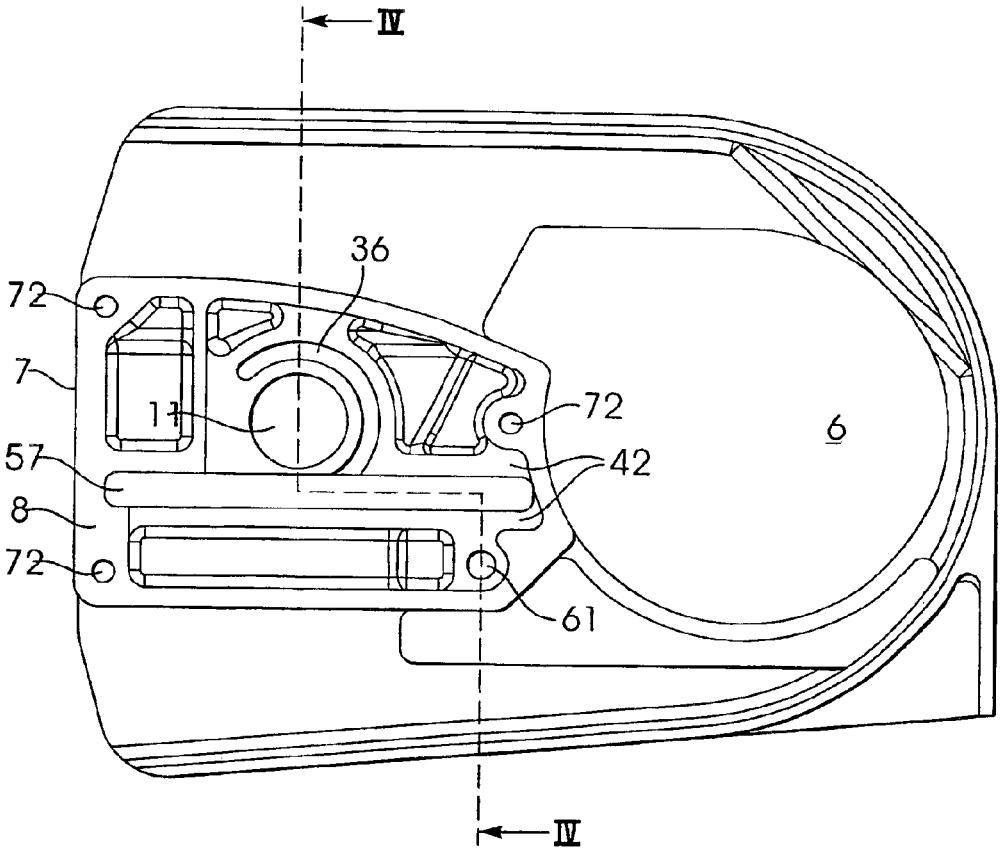

With reference first to FIG. 1–FIG. 14C, FIG. 1 shows a motor powered saw, which may have a conventional basic design. In the shown example it is powered by a combustion engine, but other power sources are also conceivable, such as hydraulic and electric.

The motor powered saw has a guide bar 1 and a saw chain 2. On the left hand side of the motor powered saw there is a side cover 3 and a handspike 4. The rear part of the side cover 3 covers a centrifugal clutch which drives the saw chain 2, which means that the side cover also serves as a cover of the centrifugal clutch, but in this text the term side cover is used in order to make it clear that the cover does not necessarily cover the centrifugal clutch.

The rear part 6 of the side cover in a conventional way serves as a clutch cover for the centrifugal clutch having a drive chain wheel inside of the clutch. In the front part of the side cover there is a thicker portion, denominated clamping plate 7 in this text. The clamping plate 7 has a plurality of recesses and a through hole, which shall be explained more in detail in the following, but in other respects the inside surface 8 is flat. Above and below the clamping plate 7 there are spaces 9 and 10 for the saw chain 2, which spaces also serve as ventilation ducts. A through hole 11 extends through the side cover 3, centrally in the region of the clamping plate 7.

Figure 4:
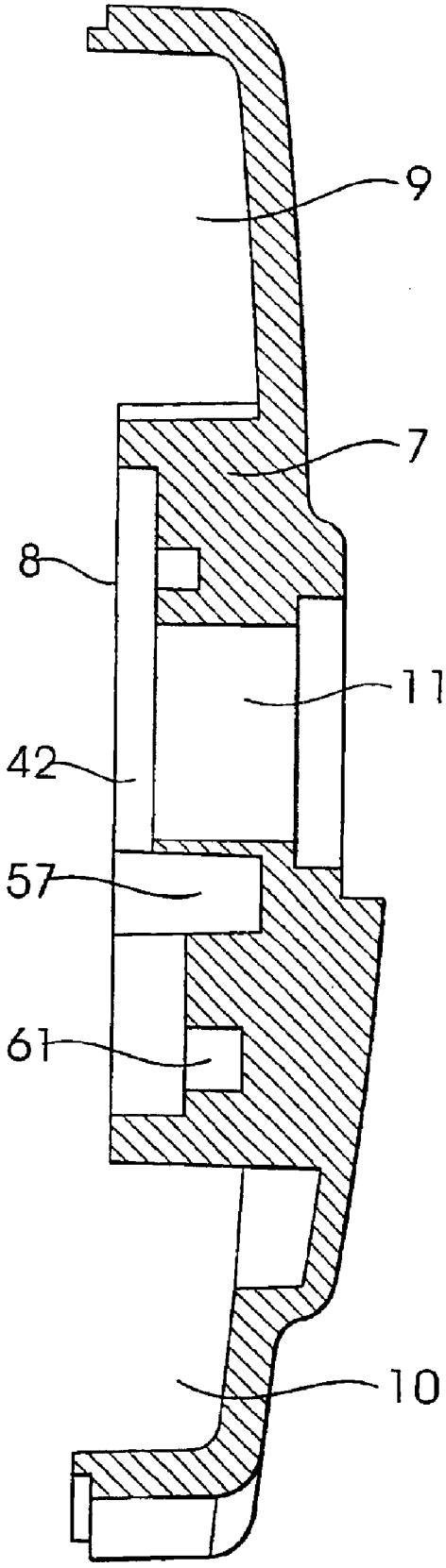
Figure 5:
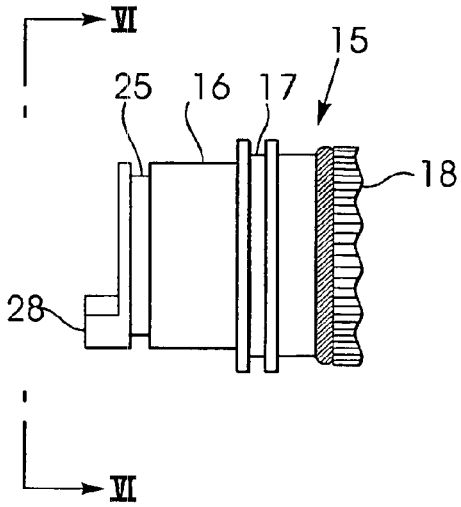
Figure 6:
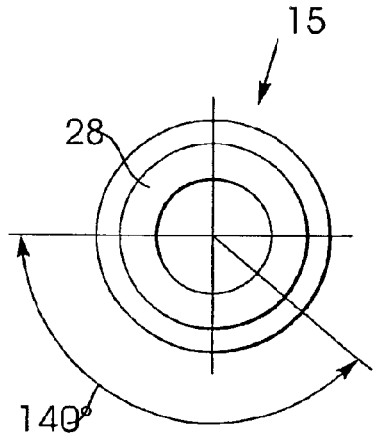

In FIG. 4 the side cover 3 is shown before those various details have been mounted, which are included in the tensioning element assembly. These details now first shall be explained with reference to FIGS. 5–13. A rotation sleeve 15, FIG. 5 and FIG. 6, has a tubular, circular cylindrical portion 16, which extends through and is rotatably. journalled in the boring 11, which has a matching shape in the side cover 3. Between a pair of annular flanges there is provided an annular groove 17 for a sealing ring. The outer end of the rotation sleeve 15 is united to a nut 18, which in turn is connected to the handspike 4. In the illustrated example the nut 18 is joined by welding to the rotating sleeve 15 and the handspike 4 is detachably in engagement with the nut 18, but also several other modes of connecting the handspike 4, the nut 18, and the rotation sleeve 15 to one another are conceivable, such that a rotational movement of the handspike 4 is transferred to the rotation sleeve 15. The nut 18 is secured by screwing to the threaded end 19 of a guide bar screw 20, which is non-rotatably secured to a guide bar support 21 via a none-rotatable sleeve 22 on the rear side of the guide bar support 21, which in turn is secured by means of screws 24 to a crankcase 23. In the region of its tubular portion 16, the rotation sleeve 15 has one more annular groove 25 for a sealing ring, and at its inner end the rotation sleeve is provided with a protrusion 28, which has the shape of a sector of an annular cylinder having a sector angle of 140°. The protrusion 28 extends axially inwards.

Figure 7:
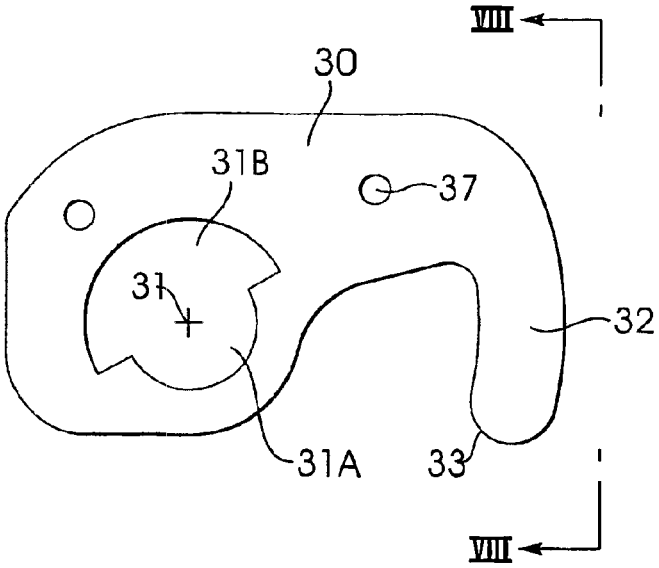
Figure 8:
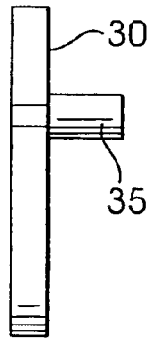

A tensioning lever is designated 30, FIG. 7 and FIG. 8. The tensioning lever 30 consists of a flat disc having a contour as is shown in FIG. 7. In its front portion, the tensioning lever has a through hole 31, which matches the cylindrical, none-threaded portion of the guide bar screw 20 and also matches the outer contour of the axial protrusion 28 on the rotation sleeve 15. The hole 31 therefore has a first portion 31 which is shaped as a sector of a circle which has the same radius as the guide bar screw 20, and a second portion 31B which has the same radius as the outer radius of the protrusion 28. The sector angle of the hole portion 31B is 180°, which is 40° larger than the sector angle of protrusion 28, in order that the tensioning lever 30 shall be able to be mounted on the guide bar screw 20 and on the protrusion 28, such that the rotation sleeve 15 shall be able to be rotated 40° from a certain starting position, which will be explained in the following, with the protrusion 28 sliding in the hole portion 31B, until the rotation sleeve by means of the protrusion 28 starts rotating the tensioning lever 30.

At its rear end, the tensioning lever 30 extends downwards to form a foot 32 having a rounded nose 33. At a short distance from a hole portion 31B, the tensioning lever 30 is provided with a guide pin 35, which when the assembly is mounted, extends into a pin groove 36, which forms a circular arc around the hole 11, FIG. 3. Further there is a securing hole 37 for a spring 40.

Figure 14A:
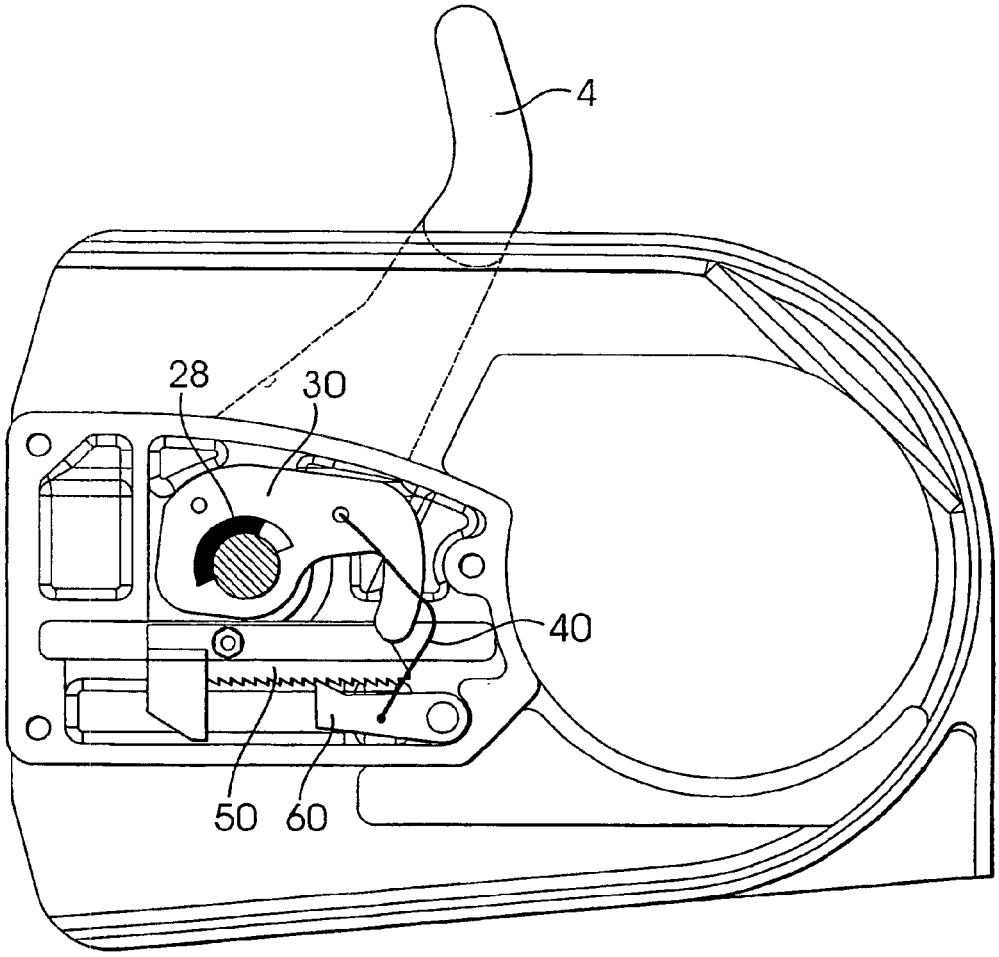
Figure 14B:
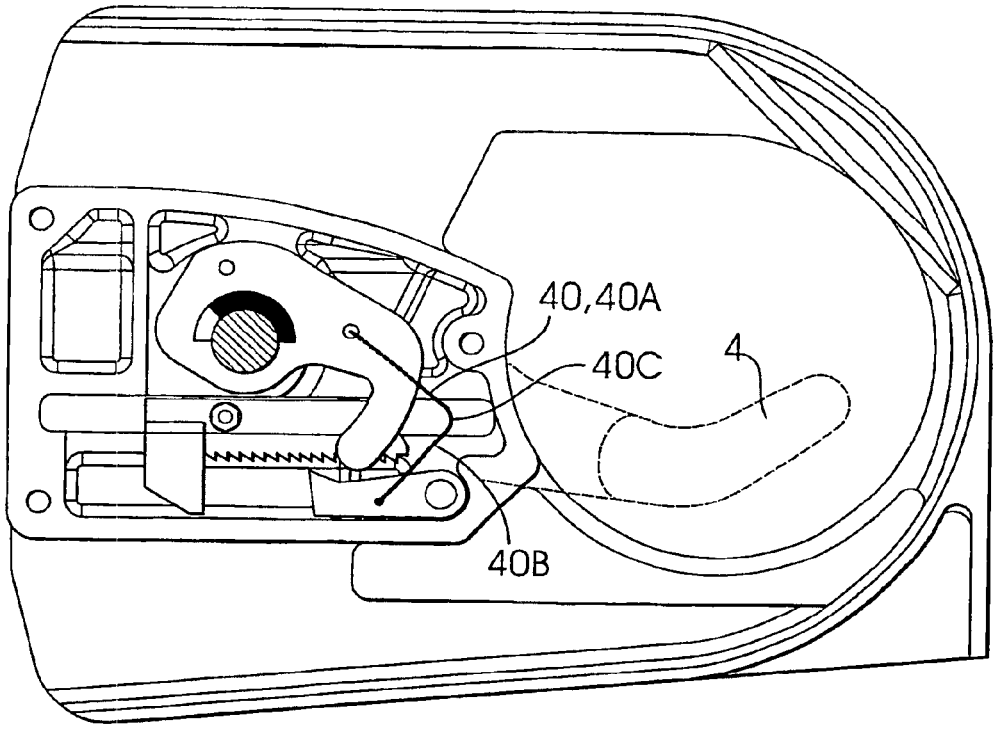

The spring 40 is designed with two shanks 40A and 40B and a knee 40C, FIG. 14B. The first shank 40A is secured in the securing hole 37 in the tensioning lever 30 and extends in the mounted assemble in a gap 41 under the tensioning lever, FIG. 13, between the tensioning lever 30 and the bottom of a comparatively shallow recess 42, FIG. 4, in the clamping plate 7.

Figure 9:
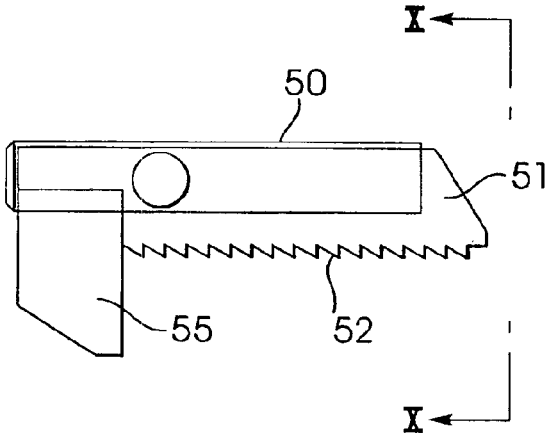
Figure 10:
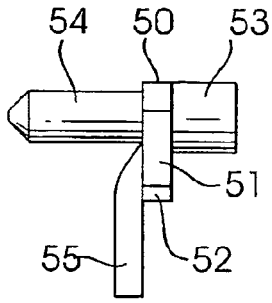

A guide bar displacer is designated 50, FIG. 9 and FIG. 10. It consists of an elongated blade 51, the lower, longitudinal edge of which is provided with teeth pointing backwards; on the side of the blade 51 turned towards the side cover 3 a longitudinal rail 53, a tensioning pin 54 extending from the blade in the opposite direction; and a lug 55, which extends downwards from the side of the blade 51 which faces the guide bar 1. The tensioning pin 54 is in engagement with the guide bar 1 therein that it is entered into a per se conventional hole in the guide bar. Two such holes are provided in a known manner in the guide bar in order to make side change of the guide bar possible. The upper one of these holes is designated 56 in FIG. 13. The rail 53 extends into a longitudinal, horizontal groove 57 in the clamping plate 7, which permits the guide bar displacer 50 to be displaced in the longitudinal direction of the guide bar 1 relative to the side cover 3, at the same time as the blade 51 slides in said shallow recess 42.

Figure 11:
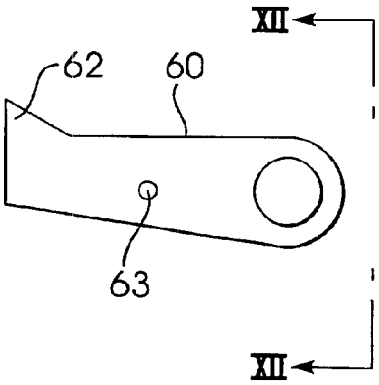
Figure 12:
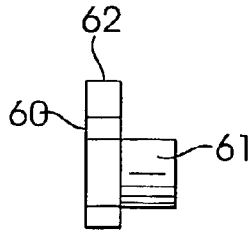
Figure 13:
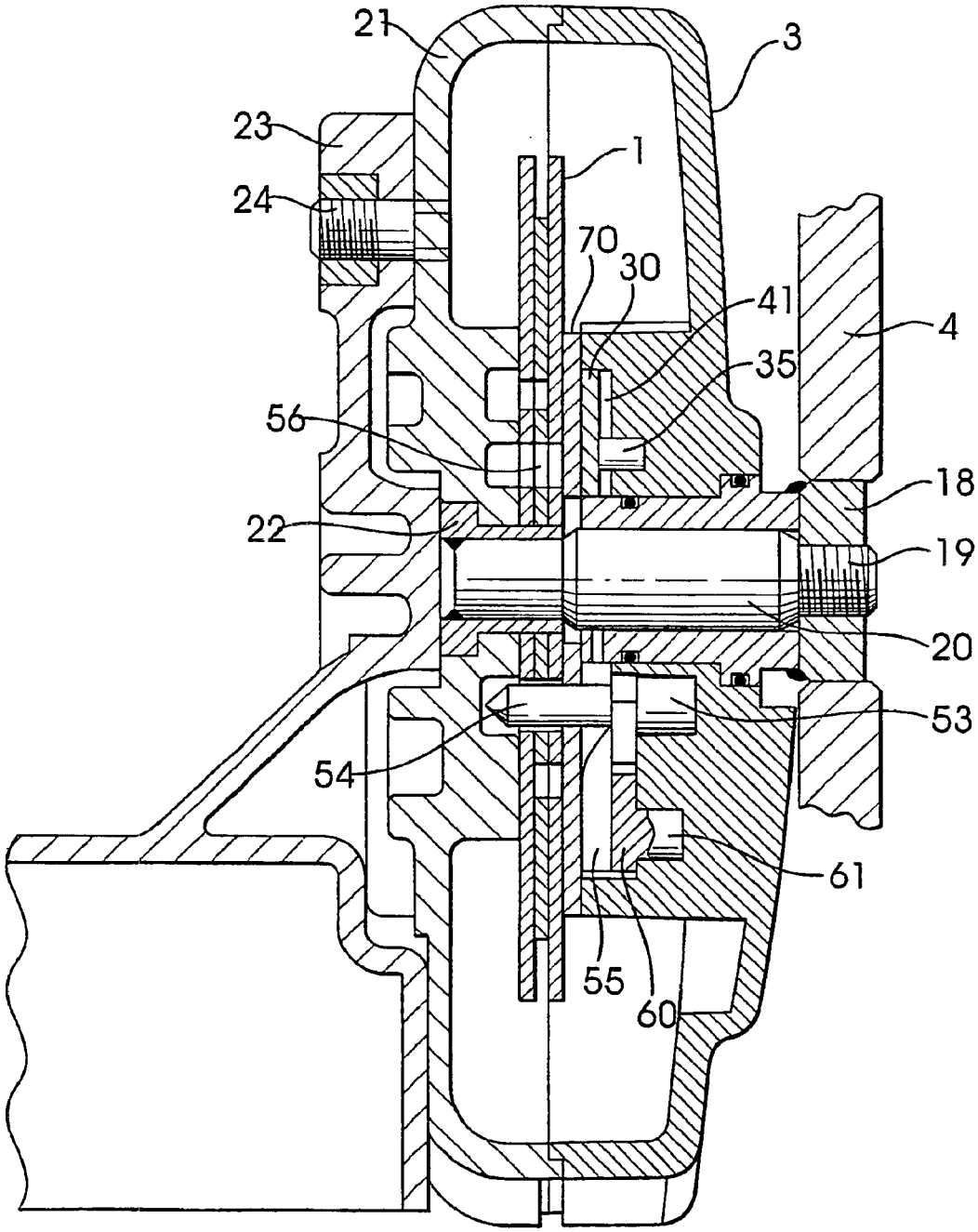

A pawl is designated 60, FIG. 11 and FIG. 12. In its rear end, the pawl is provided with a shaft pivot 61, which is rotatably entered in a circular shaft hole 62 in the clamping plate 7. The pawl 60 can be rotated about the rotational centre of the shaft pivot 61. In its front end, the pawl 60 has an upwards directed point 62 for engagement with the teeth 52 of the guide bar displacer 50 in order, in its active engagement position, to prevent the guide bar displacer to move rear-wise. The end of the shank 40B of the spring 40 is secured in a securing hole 63. The spring shank 40B extends on that side of the pawl 60 which faces the guide bar 1. In order to make this possible, at the same time as the upper shank 40A of the spring extends under the tensioning lever 30, the shank 40B of the spring 40 has a minor deflection adjacent to the knee 40C, such that the shank 40B will adopt a position in a plane of movement slightly closer to the guide bar 1 than the upper shank 40A does.

The tensioning lever 30, the spring 40, the guide bar displacer 50, and the pawl 60 are covered by a cover disc 70 with the exception of the tensioning pin 54 which extends through a longitudinal, horizontal slot in the cover disc, which permits the longitudinal, horizontal movement of the guide bar displacer 50. The cover disc 70 has the same outer contour as the clamping plate 70 and is secured to said plate by means of not shown screws in screw holes 72. In the cover disc 70 there is also provided a through hole for the guide bar screw 20.

The functioning of the described assembly of devices now shall be explained. In the normal position, the handspike 4 is directed upwards, FIG. 1, FIG. 13, and FIG. 14A. The guide bar 1 then is clamped between the side cover 4 via the cover disc 70 and the guide bar support 21 by tightening the nut 18 by means of the handspike 4. The clamping force which the nut 18 exerts in combination with the guide bar screw 20 is not sufficient for preventing the guide bar 1 to move rear wise during operation of the motor powered saw. This, however, is prevented by the pawl 60. The point 62 of the pawl, in the normal position of the pawl, is in engagement with one of the teeth 52 of the guide bar displacer 52. The tensioning pin 54 of the displacer in a manner known per se is in engagement with the lower of the holes 56 of the guide bar 1.

When the saw chain 2 shall be tensioned, the handspike 4 is rotated backwards-downwards. In the starting position, FIG. 14A, where the protrusion 28 of the sleeve 22 is black coloured, there is a sector of 40° within which the protrusion of the sleeve 22 can be rotated without action upon the tensioning lever 30. During this rotation by means of the handspike 4, the nut 18 starts easing from its firm engagement with the threaded part 19 of the guide bar screw 20. During continued rotation of the handspike 4 further 40° to the position shown in FIG. 14B, the pawl is released by means of the spring 40 from its engagement with the teeth 52 of the guide bar displacer 50. The said lateral deflection of the spring 40 facilitates said release therein that the foot 33 of the displacer 30 abuts that part of the spring 40 which lies in a plane closer to the guide bar support.

Figure 14C:
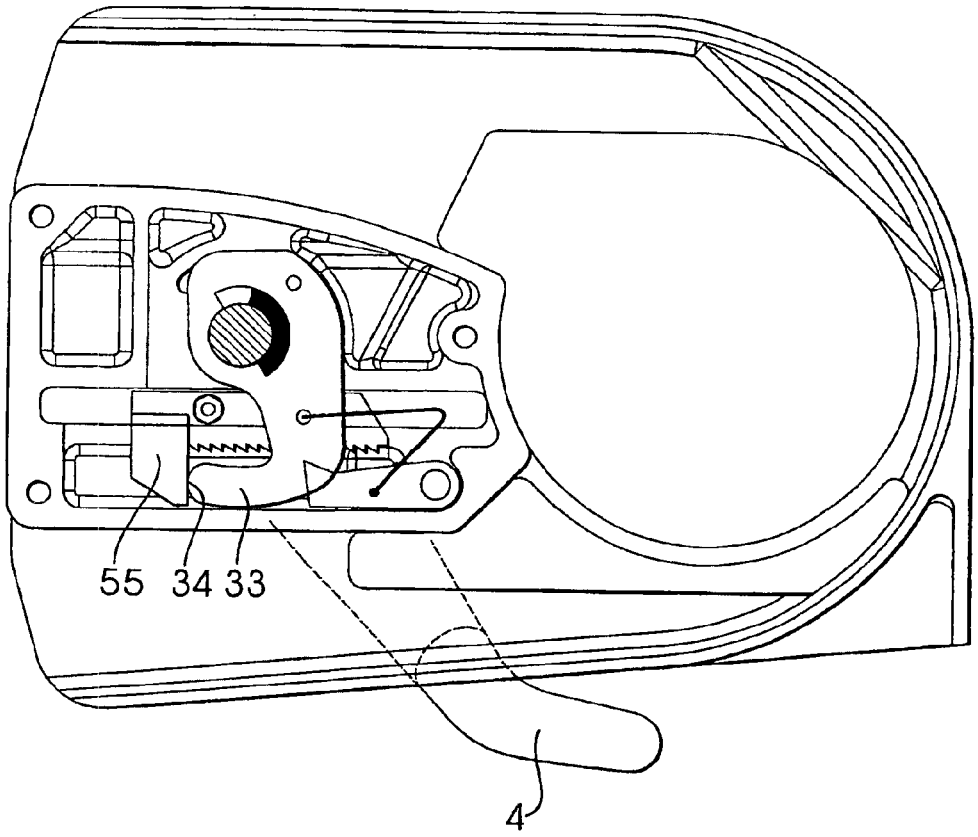
Figure 15:
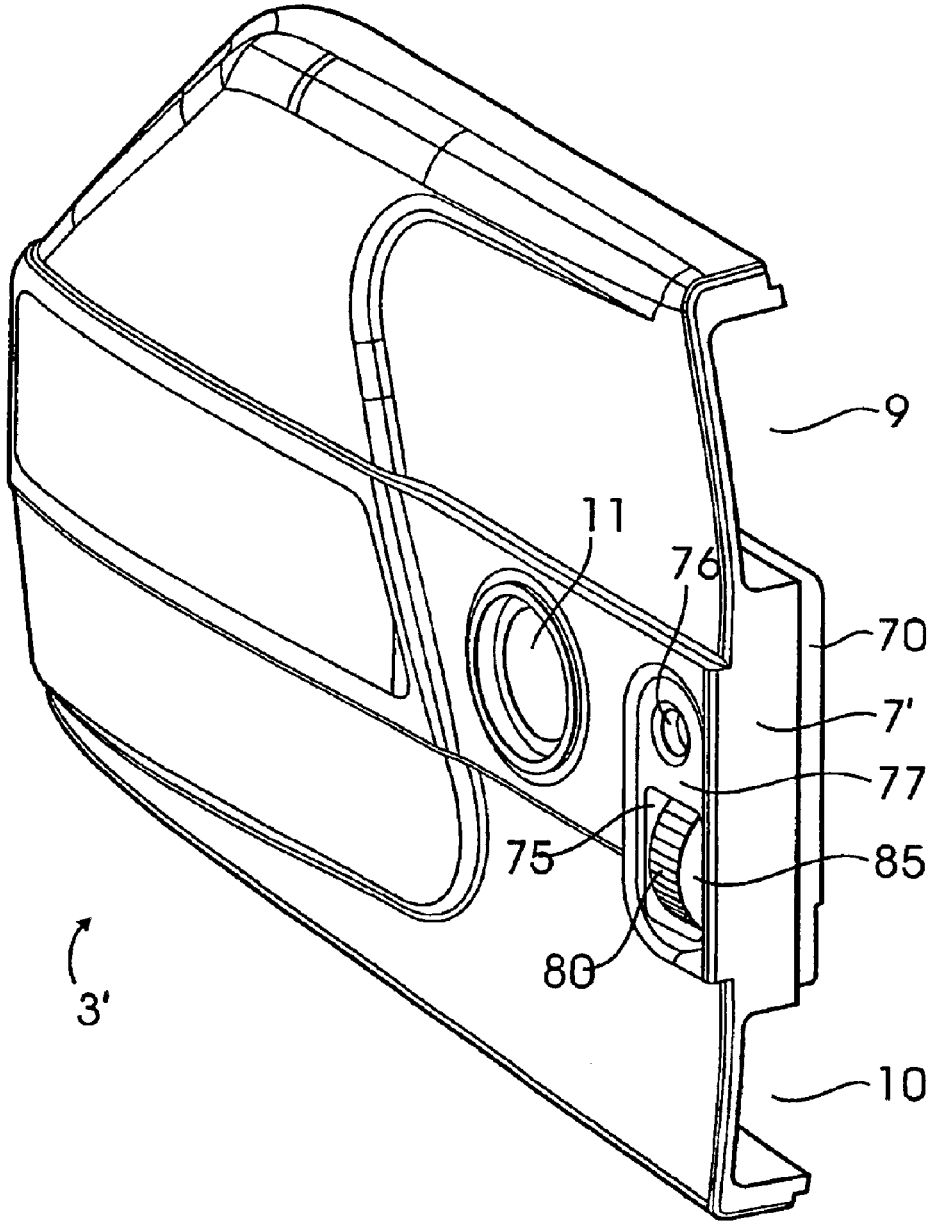
FIG. 15–FIG. 18 illustrate a second embodiment of the invention, where

By the easing of the screw 18 conditions also have been established for displacing the guide bar 1 forwards, i.e. to the left with reference to FIGS. 14A–14C. This occurs when the handspike 4 is rotated further downwards, FIG. 14C, such that the nose 34 of the foot 33 of the lever arm is pressed by means of the protrusion 28 of the rotation sleeve 15 against the lug 55 of the guide bar displacer 50. The rotational movement of the handspike 4 proceeds, wherein the guide bar displacer 50 is moved forwards and via the tensioning pin 54 displaces the guide bar 1 forwards until the chain 2 has been tensioned. Thereafter the handspike 4 is brought back to its starting position, rotating the lever arm backwards in the counter clockwise direction, causing the pawl to be lifted by the spring 40 such that it will be reengaged with any of the teeth 52 further back on the guide bar displacer 50, wherein the guide bar will be locked in its new position at the same time as the guide bar is clamped between the side cover 3 and the guide bar support 21 via the cover disc 70 by the final tightening of the nut 18. If the saw chain 2 had been tensioned too much, the handspike 4 would again moved backwards, however not so far that the nose 33 of the tensioning lever is caused to engage the lug 55 of the guide bar displacer 50, whereupon the guide bar 1 is moved backwards by the operator in a way which per se is conventional for skilled workers, e.g. therein that the operator raises the motor powered saw with the guide bar 1 pointing obliquely upwards, whereafter the handspike 4 once again is brought back to its upper normal position.

In the embodiment according to FIG. 15–FIG. 18, which now will be described, some parts, which may be identical with those which have been described in the foregoing, are not shown in the drawings. As far as these parts are concerned, reference therefore is made to the description of the foregoing embodiment. This for example concerns the general design of the machine according to FIG. 1, including the handspike 4. There is also provided a rotation sleeve which in principle has the same design as the rotation sleeve 15, the outer end of which is provided with a nut, which is fixedly connected to the handspike 4 and rotatable about a guide bar screw, corresponding to the guide bar screw 20 in the previous embodiment, which screw in its inner end is non-rotatably secured in the guide bar support 21. Details in FIG. 15–FIG. 18, which have correspondences in the previous embodiment, but which in some way are modified, have been given the same denominations as in the previous embodiment but with the addition of '. For complete equivalences the same denominations are used without the addition of '.

Figure 16:
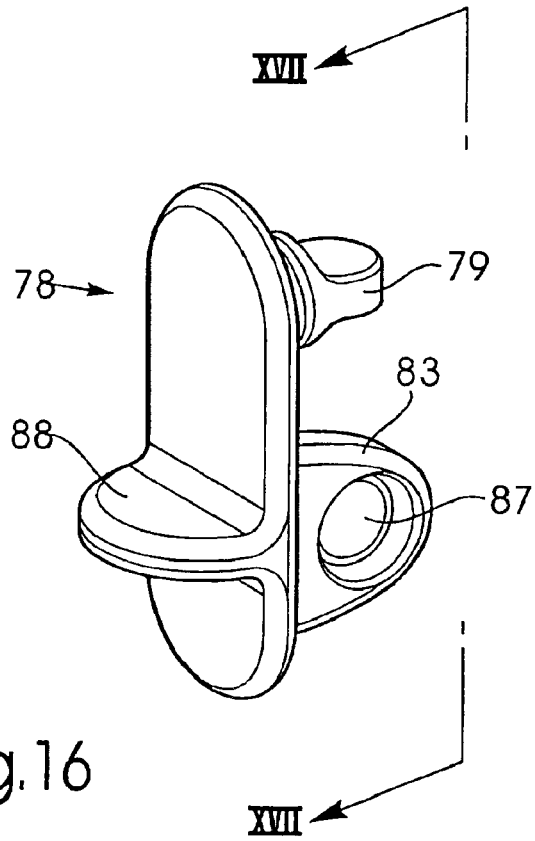
Figure 17:
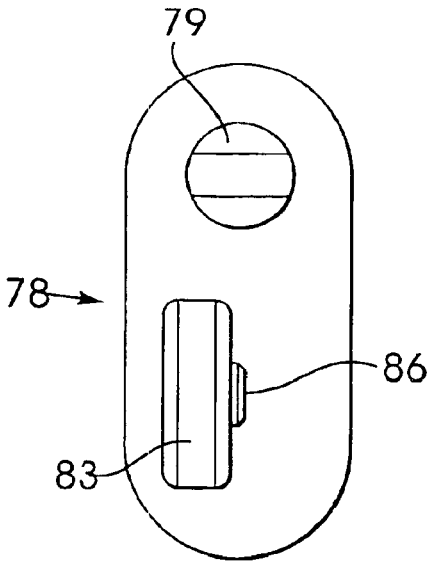

In the side cover 3' there are provided, in addition to the hole 11 for the said rotation sleeve, two more holes, namely a rectangular hole 75 which is elongated in the vertical direction, and above said hole a smaller circular hole 76. The holes 75 and 76 are surrounded by a recess 77 having a low depth and the same contour as a lid 78 of synthetic rubber which is shown in FIG. 16. On the interior, the lid 78 is provided with a securing protrusion 79 which is pressed into and secured in the hole 76. In the opening/hole 75 the knurled head of a securing screw 81 is visible in FIG. 15. On the interior side of the lid 78 there is also provided a nose shaped portion, which is integrated with the lid 78, in this text denominated rubber body 83, which can be pressed into the hole 75, which extends through a clamping plate 7' on the interior side of a side cover 3' to the left of the screw head 80 with reference to FIG. 18, i.e. to the right of the same screw head 80 with reference to FIG. 15. The rubber 83 has essentially vertical sides and a width in the horizontal direction which is slightly larger than the available space at the side of the screw head 80 in the hole 75, such that the rubber body 83, because of its elasticity, can be pressed into said space and be pressed against the screw head. The screw head 80 has a central recess 85, FIG. 15, and the rubber body 83 is correspondingly shaped. In order to facilitate that the protrusion 86 will snap-in into the recess 85, when the rubber body 83 is pressed in at the side of the screw head in the hole 75, there is a recess on the opposite side of the rubber body 83. The rubber body 83 can be pulled out from its engagement with the screw head 80 by means of a pulling handle 88 on the exterior side of the lid 78. During this operation the flexible rubber lid 78 is deflected upwards but is retained by the protrusion 79. Thereafter the lid can be turned aside, the protrusion 29 being rotated in the hole 76, so that the screw head 80 will be accessible to the operator from the exterior.

The clamping plate 7' on the interior of the side cover 3' has material reducing recesses and a number of holes and recesses adapted to the tensioning and locking functions. The through hole 75 for the screw head 80 and for the rubber body 83 has been mentioned above and also the through hole 11 for the rotation sleeve and for the guide bar screw. A counter sinking for a tensioning lever 30' is designated 90. Under the tensioning lever, part of the circle sector groove 36' for a guide pin on the tensioning lever is visible, corresponding to the guide pin 35 of the foregoing embodiment. A guide bar displacer 50' is slideably provided in a longitudinal, deep groove 92 in the clamping plate. The securing screw 81 extends in the same groove 92. Between the hole 75 and the groove 92 there is provided a transversal recess 93, which accommodates a plate 94 which is made of a softer material than the tensioning screw, suitably of brass.

The protrusion 28' in the inner end of the rotation sleeve has the shape of a segment of a circular cylinder having a peripheral length corresponding to a circle sector of 115° in that recess in the tensioning lever 30' which has a shape of an angular segment which extends around half the periphery of the guide bar screw 20. A tensioning foot on a tensioning lever 30' is designated 32' and a sole of the tensioning foot is designated 33'.

The guide bar displacer 50' includes a parallelepiped having the same width and height as the width and depth of the groove 92. A threaded hole 96 extends through the guide bar displacer 50' in the direction of the groove 92 and matches the securing screw 81. The guide bar displacer 50' in other words is a nut which can be moved in the groove 92. In the position shown in FIG. 18, the sole 33' abuts a flat ground rear side of a tensioning pin 54', which projects from the upper side of the guide bar displacer 50'. The plate 94 functions as a guide for the securing screw 81 and is for that purpose provided with a through clearance hole for the securing screw.

The cover disc 70' has a through circular hole 97 for the guide bar screw 20, a longitudinal grove 98 for the tensioning pin 54', and three countersunk holes 99, matching the screw holes 72 in the clamping plate 7'. When the cover disc 70' is secured by means of the screws on the clamping plate 71, the movable parts in the assembly are kept in their accommodations in the clamping plate by means of the cover disc, such that the side cover 3' and the clamping plate 7' with its various mechanisms form an integrated unit, which can be loosened, handled and reassembled as a unit, e.g. in connection with change of the saw chain.

Figure 18:
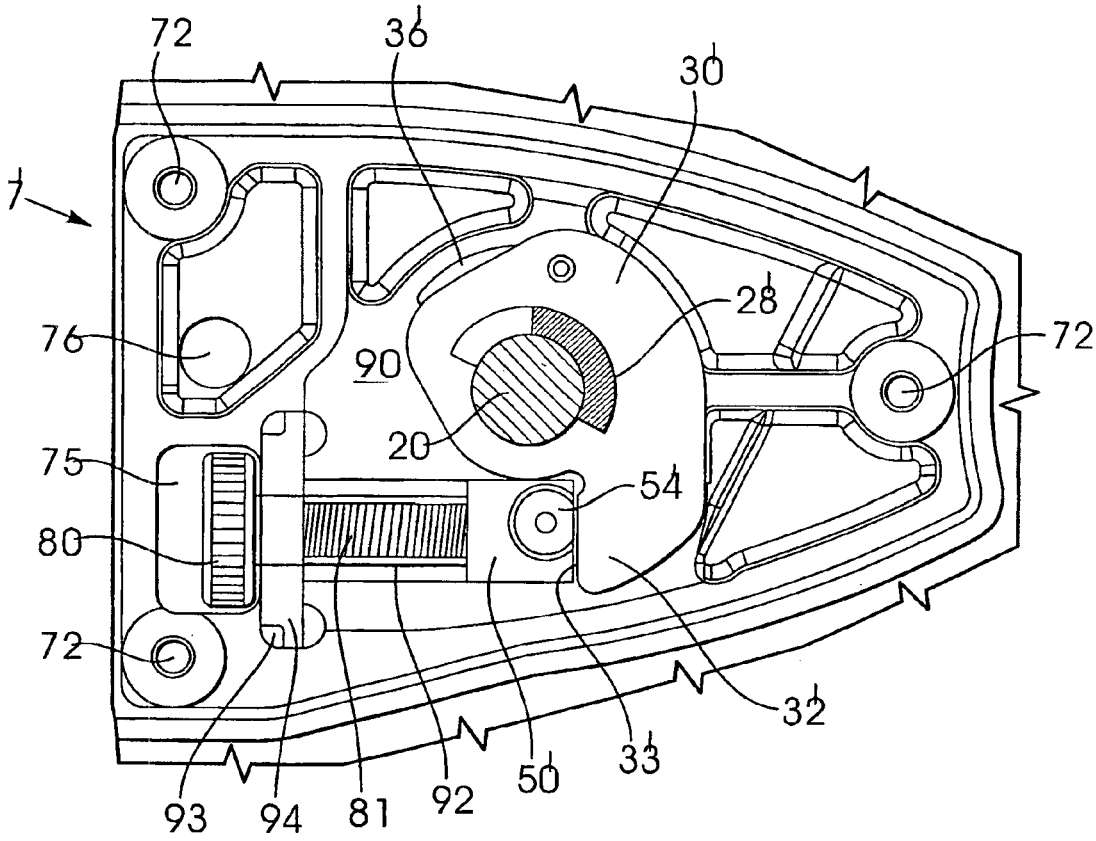
Figure 19:
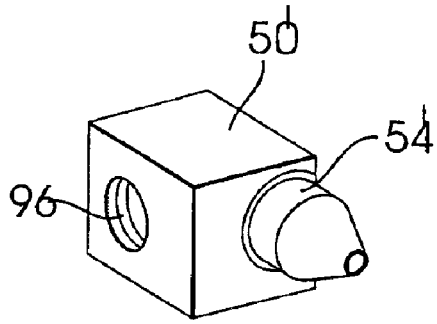
FIG. 19 is a perspective view of a tensioning runner.
Figure 20:
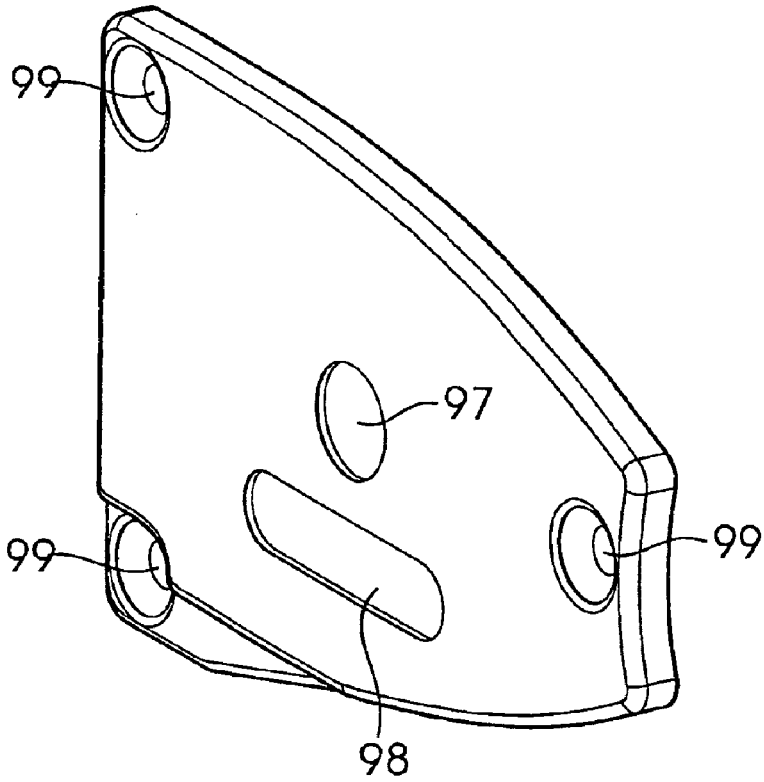
FIG. 20 shows a perspective view of the tensioning runner.

The first operation to be carried out when the saw chain shall be tensioned is to loosen the lid 78 by withdrawing the rubber body 83 from its engagement against the screw head 80 and turning the lid aside, so that the screw head 80 is exposed and can be accessed. Thereafter the operator rotates the nut shown handspike 4 backwards downwards 65°. This causes the protrusion 28' on the rotating sleeve to adopt the position which is shown in FIG. 18. The sole 33' of the tensioning lever 30' now abuts the tensioning pin 54' and the clamping force of the clamping plate 7' against the guide bar via the cover disc 70' has been eased so much that the guide bar can be displaced forwards. The latter occurs by a further rotation of the handspike 4. This causes the tensioning lever 30' to be rotated clockwise via the protrusion 28' on the rotation sleeve, FIG. 18, such that the tensioning foot 32' displaces the tensioning pin 54' and hence the guide bar to the left, FIG. 18, wherein the saw chain is tensioned. The guide bar displacer 50' at the same time displaces the securing screw 81 to the left in the groove 92 through the guide plate 94, so that the screw head moves a distance into the free space in the hole 75. When the tensioning pin 54' is being displaced, it moves in the slot 98 in the cover disc 70'.

When the saw chain thus has been tensioned to a desired degree, the operator with his left hand lifts the guide bar slightly upwards and brings with his right hand the handspike 4 back to its starting position, such that the guide bar again is clamped between the cover disc 70' and the guide bar support 21. Then the operator rotates the screw head 80 so that the locking screw 81 is screwed into the now fixed guide bar displacer 50' until the screw head contacts the guide plate 94. Finally the lid 78 is put back to its intended position, causing the rubber body 83 to be pressed into the space at the side of the screw head 80. When the saw is operated, the rubber body contributes to the functioning of the locking screw 81, and the guide bar displacer 50' functions properly as a locking member which does not move because of vibrations, which in turn contributes to the guide bar being fixed in its clamped position.

In this mode the saw chain can be repeatedly tensioned. Each time, the tensioning pin is displaced a distance forward (to the left in FIG. 18) until the saw chain has been worn so much that it must be replaced by a new chain. Before a new chain is mounted, the side cover 3' is removed and the guide bar displacer 50' is screwed back (to the right in FIG. 18) by means of the screw 81. This can also be carried out by means of the screw head 80 which is accessible on the exterior of the side cover 3'.

It should be understood that the invention is not restricted to the described embodiment. For example, the units for tensioning the saw chain and for locking it in a new position can be provided in a unit on the exterior of the side cover instead of on its interior, or in the guide bar support, when a guide bar support is provided, as according to the embodiment, or in the crankcase or in any other, corresponding part of the body of the motor which is used for driving the chain, particularly when a special guide bar support is not provided. Also modifications of the included mechanisms are conceivable within the scope of the invention.

What is claimed is:

1. Motor powered saw with a saw chain (2) and a guide bar (1), the rear portion of which is covered by a side cover (3) and during operation clamped with a certain clamping force between the side cover and a counter support on that side of the guide bar which is turned towards the motor, tensioning elements being provided for tensioning the saw chain by displacing the guide bar forwards, when the guide bar has been loosened by easing the clamping force, and elements for securing the guide bar in a new position, characterized in that a rotation element (4) is mounted or mountable on the exterior of the side cover for easing said clamping force by rotating the rotating element a first angle of rotation; for activating said tensioning elements by continued rotation of the rotation element a further, second angle of rotation, said tensioning elements comprising a guide bar displacer (50,50') for displacing the guide bar forwards to a new position for tensioning the chain; and for reclamping the guide bar, but now in the new position, by returning the rotation element to its starting position.

2. Motor powered saw according to claim 1, characterized in that said guide bar displacer is provided with a tensioning pin (54,54') which extends sidewise into a hole (56) in the guide bar, that a tensioning lever (30,30') is provided and is rotatable by said rotation element and capable of displacing the guide bar displacer in a direction towards the guide bar nose as the rotation element is rotated said second angle of rotation, and that at least one anti-reverse motion device (68, 81, 83) is provided to prevent the guide bar displacer and thence the guide bar to move, when said rotation element has been rotated back to the starting position.

3. Motor powered saw according to claim 2, characterized in that the guide bar displacer is provided with backwards directed teeth (52) and that said anti-reverse motion device consists of a pawl with a point (62), which is in engagement with any of said teeth in a locking position of the guide bar displacer.

4. Motor powered saw according to claim 3, characterized in that the guide bar displacer consists of a slide, which is displaceable in the longitudinal direction of the guide bar, and that said teeth (52) form a straight row of teeth on the guide bar displacer, parallel with the longitudinal direction of the guide bar.

5. Motor powered saw according to claim 2, characterized in that the guide bar displacer comprises a nut (50'), which is displaceable in the longitudinal direction in a groove (92), and that said anti-reverse motion device comprises a screw (81), which is screwed through the nut and extends in said groove (92).

6. Motor powered saw according to claim 5, characterized in that said anti-reverse motion device comprises a rubber body (83), which in the working condition of the saw is fixedly pressed against a screw head (80) of the screw.

7. Motor powered saw according to claim 1, characterized in that the guide bar displacer comprises a nut (50'), that a screw (81) which matches the nut extends through the nut in the longitudinal direction of the guide bar, and that a head (80) of the screw is accessible on the exterior of the side cover through a hole (75) in the side cover.

8. Motor powered saw according to claim 1, characterized in that the tensioning lever (30, 30') is rotatable by means of a rotating sleeve (15), which is provided to be rotated by said rotation element (4).

9. Motor powered saw according to claim 8, characterized in that the rotating sleeve (15) is provided to be initially rotated a certain angle from that position which the rotating sleeve normally occupies when the guide bar is clamped between the side cover and said support, and that the rotating sleeve does not act on the tensioning lever (30, 30') during said initial rotation.

10. Motor powered saw according to claim 1, characterized in that the rotation element is joined to or can be joined to a nut (18) on the exterior of the side cover, which nut cooperates with a guide bar screw (20) which extends through the guide bar and which is non-rotatably secured to said support for the achievement of said clamping force.

11. Motor powered saw according to claim 1, characterized in that said anti-reverse motion device (60) is connected to the tensioning lever (30) by means of a spring (40).

12. Motor powered saw according to claim 1, characterized in that said tensioning lever and guide bar displacer are substantially covered by a cover disc (70, 70') which rests against the guide bar.

13. Motor powered saw according to claim 2, characterized in that said tensioning lever and said guide bar displacer are substantially provided in recesses in a clamping plate (7, 7') which faces the guide bar on the interior of the side cover.

14. Motor powered saw according to claim 2, characterized in that said tensioning lever and said guide bar displacer are substantially provided in a unit on the exterior of the side cover.

15. Motor powered saw according to claim 2, characterized in that said tensioning lever and said guide bar displacer are substantially provided in recesses in said support (21).

16. Motor powered saw according to claim 15, characterized in that said support consists of a guide bar support (21), which is mounted on a crankcase (23) or other part of the drive machinery of the motor powered saw.

* * * * *